US006082430A

United States Patent [19]

Mock

[11] Patent Number: 6,082,430

[45] Date of Patent: Jul. 4, 2000

[54] GARAGE DOOR SAFETY BRACKET

[75] Inventor: Loren D. Mock, Baldwin City, Kans.

[73] Assignee: Amarr Garage Doors, Lawrence, Kans.

[21] Appl. No.: 09/287,672

[22] Filed: Apr. 7, 1999

[51] Int. Cl.[7] ..... E05D 15/16

[52] U.S. Cl. ..... 160/201; 248/551; 160/191; 49/200

[58] Field of Search ..... 160/201, 191, 160/192, 193; 248/551; 49/199, 200

[56] References Cited

U.S. PATENT DOCUMENTS

| | | | |
|---|---|---|---|
| 1,747,206 | 2/1930 | Wilson | 160/191 |
| 2,291,583 | 7/1942 | Rowe | 160/201 |
| 2,793,690 | 5/1957 | Stroup . | |
| 3,213,924 | 10/1965 | Crosswell | 160/191 |
| 3,398,244 | 8/1968 | Ertl et al. | 248/551 |
| 4,083,620 | 4/1978 | Burgin | 248/551 |
| 5,404,927 | 4/1995 | Bailey . | |
| 5,495,640 | 3/1996 | Mullet et al. . | |
| 5,697,233 | 12/1997 | Albert et al. | 248/551 |
| 5,960,849 | 10/1999 | Delaney et al. | 160/188 |

*Primary Examiner*—Blair M. Johnson
*Attorney, Agent, or Firm*—Hovey, Williams, Timmons & Collins

[57] ABSTRACT

A garage door safety bracket (26) utilizes a fixed member (42) and a sliding member (44) to inhibit removal of the bracket (26) while there is tension in a cable (40) which is attached to the sliding member (44). The sliding member includes three access apertures (68) and moves between tensioned and untensioned positions. Tension in the cable (40) forces the sliding member into the tensioned position in which the access apertures (68) are offset from panel fasteners (48) which attach the bracket (26) to a lower panel (30L) of a garage door (22). When the tension on the cable (40) is released, the sliding member (44) slides into the untensioned position in which the access apertures (68) are aligned with the panel fasteners (48) permitting access to the panel fasteners (48). A roller mount (46) is separately attached to the sliding member (44) by roller mount fasteners (74) which permit a lower roller (32L) to be serviced without releasing the tension on the cable (40).

18 Claims, 3 Drawing Sheets

GARAGE DOOR SAFETY BRACKET

FIELD OF THE INVENTION

This invention relates to garage doors and, more particularly, to garage door safety brackets that attach spring tensioned cables to garage doors.

BACKGROUND OF THE INVENTION

Garage door assemblies typically include spring tensioned cables connected to lower panels of the doors. Frequently, the cables are connected to bottom cable connecting brackets which also mount lower rollers to guide the garage doors in tracks as the doors are opened and closed. When performing maintenance on these garage doors, it is frequently necessary to release the tension on the cables. This can be done safely while the doors are in their open positions or by simply releasing the tension of torsion springs. However, individuals, such as homeowners and occasionally trained repairmen, will sometimes attempt to repair a bottom roller without releasing the tension on the springs or will release the tension on the springs by removing the bottom brackets. Additionally, a child playing with a wrench has easy access to the bottom brackets of a garage door. Once the final fastener is removed from a bottom bracket, the springs retract rapidly causing fasteners, brackets, rollers, cables, and springs to become dangerous projectiles and create dangerous pinch points.

Thus, it is desirable to construct a garage door assembly that inhibits individuals from detaching the bottom cable connecting brackets without first releasing the tension in the springs. It is further desirable to have a garage door assembly in which the bottom rollers can be changed without releasing the tension on the cables.

BRIEF SUMMARY OF THE INVENTION

There is, therefore, provided in the practice of the invention a novel garage door safety bracket, which inhibits individuals from removing the bracket when the cables of a garage door assembly are tensioned, thereby reducing the likelihood of injury to individuals performing maintenance on the garage door assembly. The bracket includes a sliding member and a substantially fixed member. The sliding member slides between a tensioned position and an untensioned position, and the fixed member includes a tension stop for holding the sliding member in the tensioned position.

In a preferred embodiment the fixed member includes a plurality of attachment apertures, and the sliding member includes a plurality of access apertures. When the sliding member is in the untensioned position, the access apertures are aligned with the attachment apertures, and when the sliding member is in the tensioned position, the access apertures are offset from the attachment apertures. The fixed member includes inwardly extending side walls that slidably receive outwardly extending side walls of the sliding member. The sliding member also includes an outwardly extending top wall which is positioned between the tension stop and an untensioned stop also attached to the fixed member. The tension stop and untensioned stop combine to keep the sliding member from separating from the fixed member. The bracket also preferably includes a roller mount attached to the sliding member by roller fasteners. Thus, the roller mount can be removed from the sliding member by removing the roller fasteners without releasing the spring tension.

The invention contemplates using the bracket in conjunction with a garage door assembly having a plurality of interconnected garage door panels, opposed track members, springs, and cables connected to and tensioned by the springs. The plurality of rollers attached to the garage door panels are rollably received in the opposed track members. A plurality of panel fasteners attach the fixed member to a lower one of the garage door panels. The fasteners are preferably positioned between the fixed member and the sliding member. When the sliding member is in the untensioned position the access apertures are aligned with the panel fasteners, and when the sliding member is in the tensioned position, the access apertures are offset from the panel fasteners.

The invention further contemplates utilizing the bracket in a method for performing maintenance on a garage door. The method comprises releasing tension from a spring, sliding the sliding member from the tensioned position to the untensioned position, so that the access apertures are aligned with the panel fasteners. The panel fasteners are then removed.

In a preferred embodiment, the panel fasteners are tightened to reattach the fixed member to the garage door panel, and the spring is tensioned moving the sliding member to the tensioned position, so that the access apertures are offset relative to the panel fasteners. Because the roller mount is attached to the sliding member, the roller mount can be removed without releasing the tension in the spring.

Accordingly, it is an object of the present invention to provide an improved garage door safety bracket for reducing the risk of injury to individuals working on garage door assemblies.

It is another object of the present invention to provide an improved garage door safety bracket which permits repair of bottom rollers without releasing tension from springs of garage door assemblies.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 2:
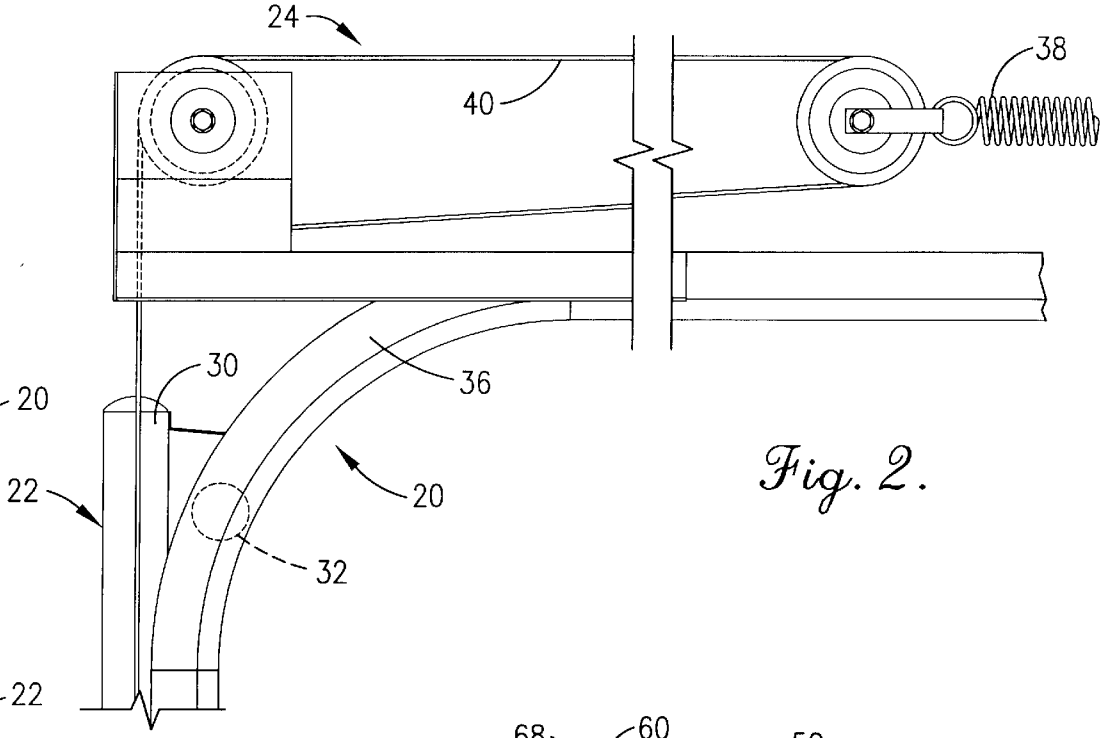
FIG. 2 is a fragmentary side view of the garage door assembly and safety bracket of FIG. 1.
Figure 1:
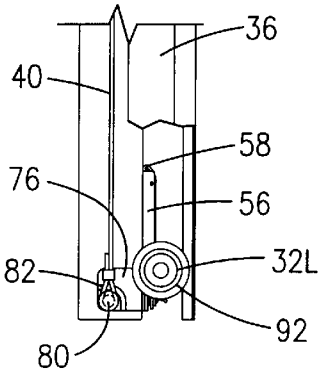
FIG. 1 is a fragmentary inside view of approximately one half of a garage door assembly including a garage door safety bracket according to the present invention.
Figure 1:
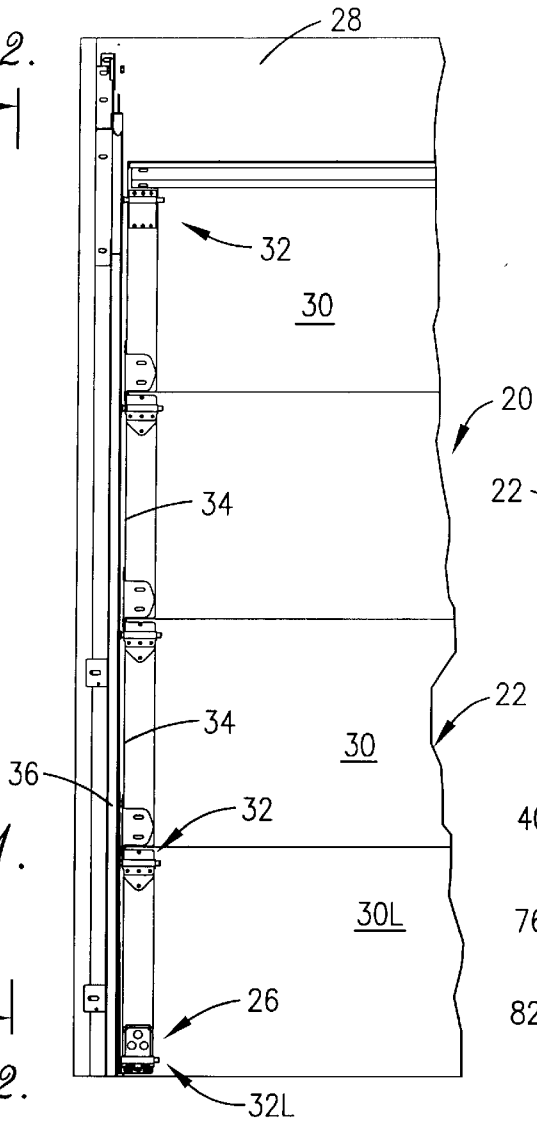

Referring to the drawings in greater detail, FIGS. 1 and 2 show a garage door assembly 20 including an overhead garage door 22, a lift system 24, and a garage door bottom bracket assembly 26 attached to the garage door 22. The lift system 24 connects to the bottom bracket assembly 26, so that the bottom bracket assembly generally cannot be removed until tension in the lift system 24 has been released.

The garage door 22 is movable between open and closed positions to open and close an opening in a garage wall 28. The garage door 22 has a plurality of interconnected garage door panels 30 and a plurality of rollers 32 rotatably attached near and extending beyond the side edges 34 of the panels 30. The rollers are rollably received in a pair of opposed tracks 36 (only one shown) attached to the garage wall 28 at the sides of the opening in the garage wall 28 to guide the garage door 22 between its open and closed positions.

The lift system 24 applies an upward force to the garage door 22 by application of a spring force to the garage door 22. To that end, a pair of springs 38 (only one shown) each attached to one of a pair of cables 40 (only one shown) are connected to the bottom bracket assemblies 26 also provided in a pair. The springs 38, which can be extension springs or torsion springs, operatively tension the cables 40 which in turn pull on the bottom bracket assembly 26 and thus the garage door 22.

Figure 7:
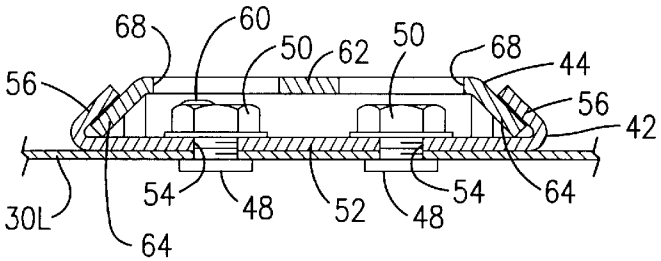
FIG. 7 is a horizontal, cross sectional view of the safety bracket taken along line 7—7 in FIG. 5.
Figure 6:
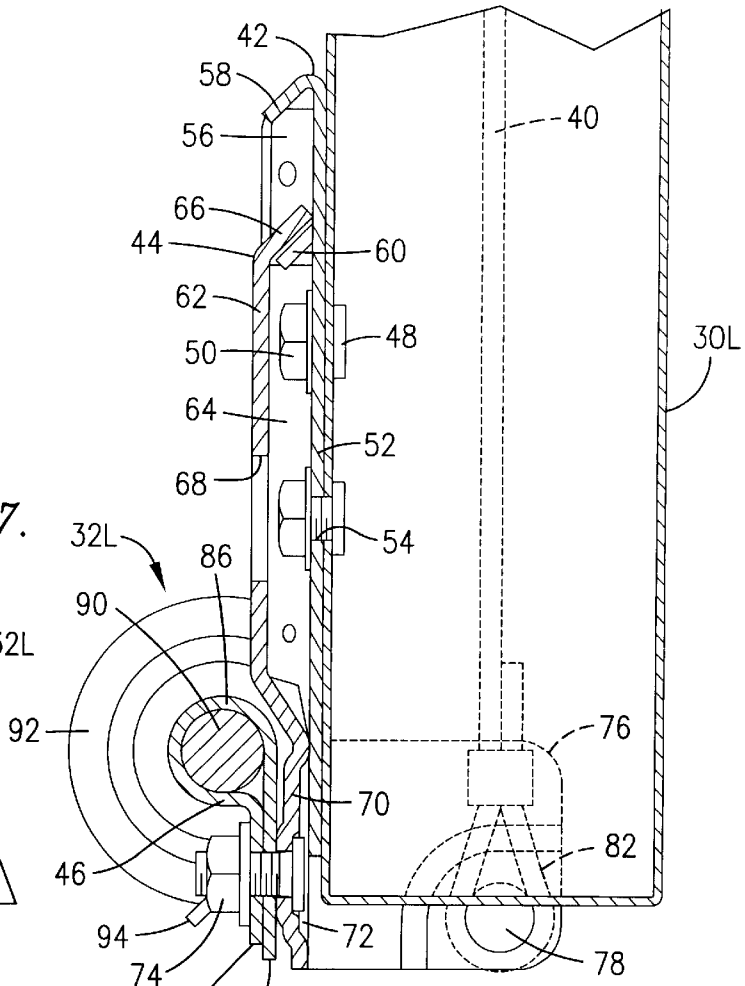
FIG. 6 is a vertical, cross sectional view of the safety bracket taken along line 6—6 in FIG. 5.

Referring to FIGS. 6 and 7, the bottom bracket assembly 26 includes a fixed member 42, a sliding member 44, and a roller mount 46. The fixed member 42 is attached in a substantially fixed position to a lower garage door panel 30L by a plurality of panel fasteners 48, preferably three, which have their wrenching surfaces 50 positioned between the fixed member 42 and the sliding member 44.

The fixed member 42 preferably comprises a metal plate having a generally flat fixed body 52 defining a plurality, preferably three, attachment apertures 54 therethrough for receiving the panel fasteners 48. The attachment apertures 54 are preferably arranged in a triangular configuration The fixed member 42 includes opposed side walls 56 which extend inwardly to form acute angles with the body 52. A top wall 58 also extends inwardly at an acute angle. The top wall 58 acts as a tension stop to hold the sliding member in a tensioned position. An untensioned stop 60 is attached to the flat body and is inclined downwardly, so that it is substantially parallel to the tension stop 58. The untensioned stop 60 is spaced away from the tension stop 58 and the side walls 56 to keep the sliding member 44 from falling out of or otherwise separating from the fixed member 42.

The sliding member 44 is adjacent to the fixed member 42 and includes a generally flat side body 62 with outwardly extending side walls 64 which extend at an obtuse angle with the body 62. The sliding member also includes an outwardly extending top wall 66 which is positioned between the tension stop 58 and the untensioned stop 60. The body of the sliding member 44 is spaced apart from the body 52 of the fixed member 42, so that there is space to receive the panel fasteners 48 therebetween. The body 62 of the sliding member defines a plurality, preferably three, of access apertures 68. The access apertures 68 are vertically aligned with the attachment apertures 54 and the panel fasteners 48, but the sliding member slides relative to the fixed member; so that when the sliding member 44 is pulled upwardly into the tensioned position where the top wall 66 contacts the tension stop 58, the access apertures 68 are offset from the attachment apertures 54 and the panel fasteners 48. When tension in the spring 38 is released, the sliding member 44 is free to slide into the untensioned position in which the top wall 66 contacts the untensioned stop 60 and the access aperture 68 are aligned with the attachment apertures 54. Thus, the untensioned stop 60 is positioned to align the access apertures with the panel fasteners 48.

The sliding member 44 also includes a roller attachment flange 70 having a back side recess 72 to receive roller mount fasteners 74 which attach the roller mount 46 to the roller attachment flange 70. The recess 72 in the roller attachment flange 70 allow the sliding member to slide relative to the fixed member without interference from the roller mount fasteners 74. A cable attachment flange 76 extends inwardly, that is toward the exterior of the garage door 22, from the roller attachment flange 70. A cylindrical cable attachment part 78 extends from the cable attachment flange 76 and includes an enlarged cylindrical end 80. The cable 40 includes a terminal loop 82 which loops over the cable attachment part 78 and is held thereon by the enlarged end 80.

The roller mount 46 is attached to the roller attachment flange 70 by the roller mount fasteners 74 of which there is at least one but preferably two. The roller mount comprises an integral piece having a base 84, a cylindrical roller axle holder 86, and a pair of clamp legs 88. The roller mount fasteners 74 extend through the clamp legs 88 and the base 84 to clamp an axle 90 of the lower roller 32L in the axle holder 86. A wheel 92 of the lower roller 32L extends from the axle 90 into the track 36. The roller mount also includes an apertured tang 94 which provides a tie point for a pull rope (not shown). The tang 94 is preferably positioned between the clamp legs 88 and extends away from the base 84.

Figure 5:
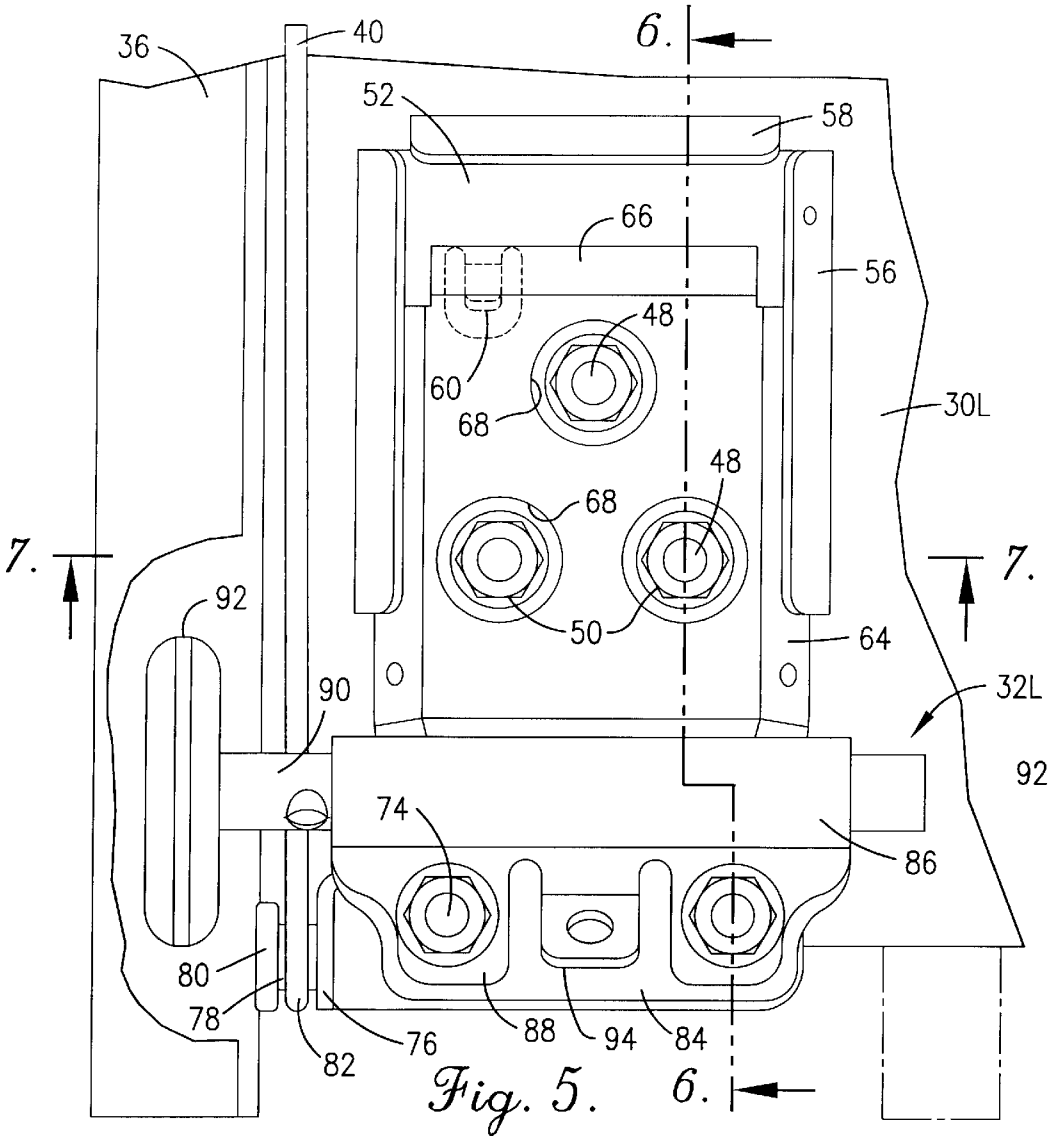
FIG. 5 is a front view of the safety bracket illustrating the sliding member in an untensioned position.

In operation, and with reference to FIGS. 5 and 6, the bottom bracket assembly 26 is installed on a lower garage door panel 30L by sliding the sliding member into the untensioned position, as illustrated. While in the untensioned position, the access apertures 68 are aligned with the attachment apertures 54 and the panel fasteners 48, so that an individual can get a wrench onto the wrenching surfaces 50 of the panel fasteners 48 and tighten the panel fasteners. Once the panel fasteners 48 are tightened, they hold the fixed member in a substantially fixed position with respect to the lower panel 30L. The spring 38 is then tensioned which in turn tensions the cable 40 pulling upwardly on the sliding member 44. The sliding member top wall 66 is lifted off of the untensioned stop 60 until it contacts the tension stop 58. As the sliding member moves from the untensioned position to the tensioned position the sliding member side walls 64 slide inside of the fixed member side walls 56. The sliding member side walls 64 are preferably substantially parallel to the corresponding fixed member side walls 56, so that the sliding member smoothly transitions from the untensioned position to the tensioned position. The sliding member top wall 66 is substantially parallel to the untensioned stop 60 and the tensioned stop 58, so that the sliding member is securely held in the untensioned and tensioned positions, respectively.

Figure 4:
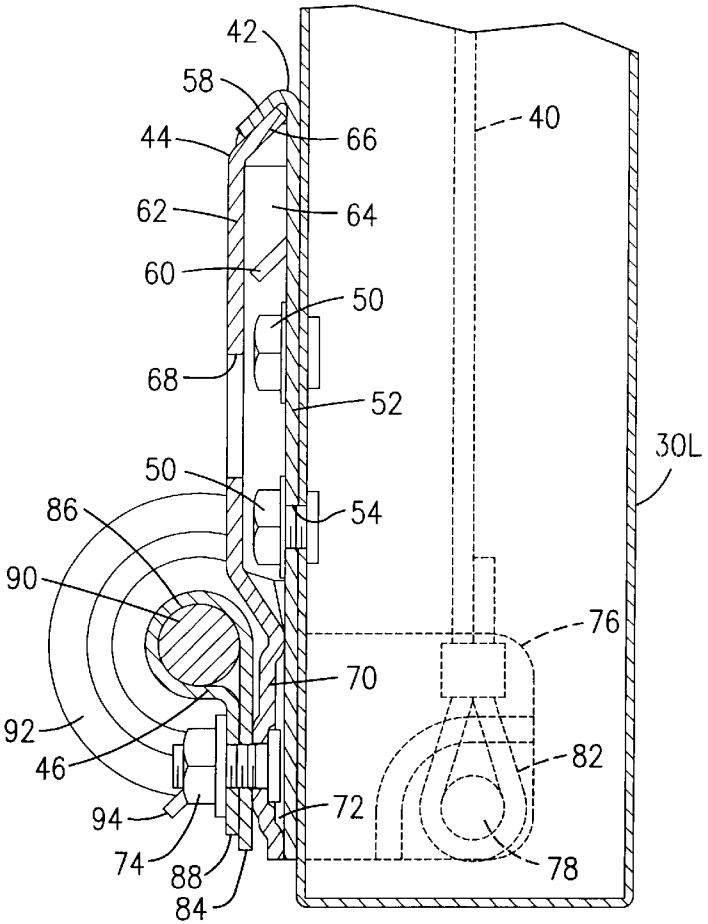
FIG. 4 is a vertical, cross sectional view of the safety bracket taken along line 4—4 in FIG. 3.
Figure 3:
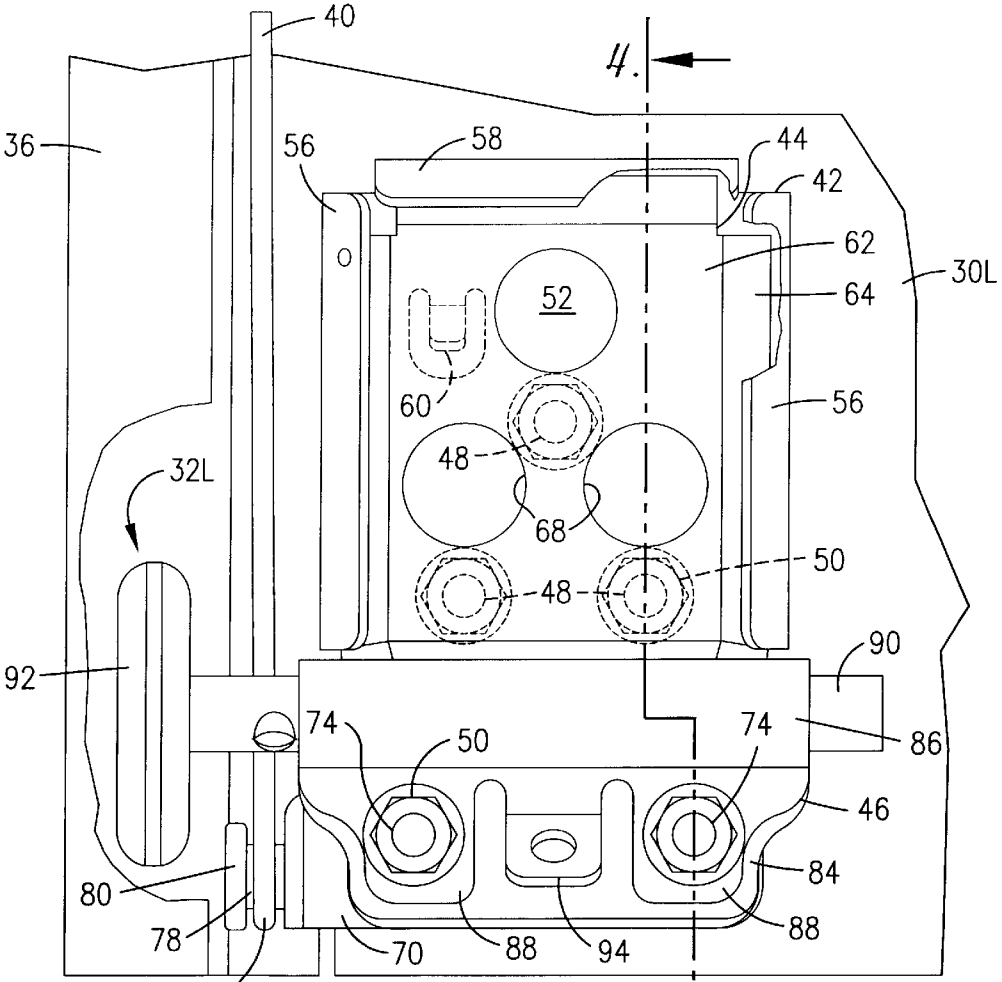
FIG. 3 is a front view of the safety bracket illustrating a sliding member of the safety bracket in a tensioned position.

As illustrated in FIGS. 3 and 4, an individual cannot gain access to the panel fasteners 48 when the sliding member 44 is in the tensioned position. This inhibits, if not prevents, the panel fasteners 48 from being loosened while the spring 38 and cable 40 are under tension. If the lower roller 32L needs repair or replacement, the roller mount fasteners 74 are loosened or removed as desired to gain access to the lower roller. Thus, it is possible to perform maintenance on the lower roller without releasing tension from the spring and cable. If more extensive maintenance is required, the tension is released from the spring allowing the sliding member to move downwardly until the sliding member top wall 66 contacts the untensioned stop 60 thereby holding the sliding member in the untensioned position of FIGS. 5 and 6. Again, with the sliding member in the untensioned position, the access openings are aligned with the fasteners, so that an individual can loosen the panel fasteners 48 from the lower panel 30L.

The garage door safety bracket 26 according to the present invention provides a safe and effective connection between a garage door 22 and its spring tensioned lift system 24. The garage door safety bracket 26 inhibits access to the panel fasteners 48 when the spring 38 is tensioned to reduce the likelihood of injury, and the roller mount 46 can be removed without releasing the tension from the spring 38 thereby simplifying maintenance of the lower roller 32L.

Thus, a garage door safety bracket is disclosed which utilizes a sliding member to inhibit removal when the spring is tensioned thereby reducing the likelihood of injury. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A garage door assembly comprising:

a plurality of interconnected garage door panels;

a track;

a spring:

a cable connected to and operatively tensioned by the spring;

a plurality of rollers attached to the garage door panels and being rollably received in the track; and a safety bracket attached to one of the panels and including sliding member having a cable attachment part attached to the cable and being slidable between a tensioned position and an untensioned position; and a substantially fixed member attached to the panel for engaging and holding the sliding member in the tensioned position; said substantially fixed member having fasteners attaching said substantially fixed member to said panel, said fasteners being accessible only when said sliding member is in said untensioned position.

2. The garage door assembly according to claim 1 wherein the fixed member defines a plurality of attachment apertures for said fasteners, and the sliding member defines a plurality of access apertures which are aligned with the attachment apertures when the sliding member is in the untensioned position and which are offset from the attachment apertures when the sliding member is in the tensioned position.

3. The garage door assembly according to claim 1 wherein the fixed member includes inwardly extending side walls which slidably receive the sliding member.

4. The garage door assembly according to claim 3 wherein the sliding member includes outwardly extending side walls which are slidably received by the fixed member side walls.

5. The garage door assembly according to claim 1 wherein the fixed member includes a downwardly inclined untensioned stop, and the tension stop comprises an inwardly extending top wall.

6. The garage door assembly according to claim 1 wherein the sliding member includes a roller mount, and the cable attachment part comprises a cylinder having an enlarged end.

7. The garage door assembly according to claim 1 wherein the sliding member includes a slide body spaced apart from a fixed body of the fixed member.

8. The garage door assembly according to claim 1 further comprising a roller mount removably connected to the sliding member.

9. The garage door assembly according to claim 1 further comprising a roller mount connected to the sliding member by at least one roller fastener.

10. A garage door assembly comprising:

a plurality of interconnected garage door panels including a lower panel;

a track;

a spring;

a cable connected to and operatively tensioned by the spring;

a plurality of rollers attached to the garage door panels and being rollably received in the track;

a bottom bracket assembly including a sliding member having a cable attachment part with the cable attached thereto and being slidable between a tensioned position and an untensioned position, a substantially fixed member having a tension stop for engaging and holding the sliding member in the tensioned position, and a plurality of panel fasteners each having a portion thereof positioned between the fixed member and the sliding member and attaching the fixed member to the lower panel the panel fasteners being accessible only when the sliding member is in the untensioned position.

11. The assembly according to claim 10 wherein the sliding member comprises a plurality of access apertures which are aligned with the panel fasteners when the sliding member is in the untensioned position and which are offset from the panel fasteners when the sliding member is in the tensioned position.

12. The assembly according to claim 10 wherein the sliding member includes outwardly extending side and top walls, and the fixed member includes inwardly extending side and top walls, the fixed member side walls slidably engage the sliding member side walls to hold the sliding member adjacent to the fixed member, and the fixed member top wall engaging the sliding member top wall when the sliding member is in the tensioned position.

13. The assembly according to claim 10 wherein the bottom bracket further includes a roller mount.

14. The assembly according to claim 13 wherein the roller mount is removably fastened to the sliding member.

15. The assembly according to claim 10 wherein the bottom bracket includes at least one roller mount fastener attaching a roller mount to the sliding member.

16. A method for performing maintenance on a garage door, the method comprising:

releasing tension from a tension spring coupled with the garage door;

sliding a sliding member that is attached to the tension spring from a tensioned position to an untensioned position to align a plurality of access apertures in the sliding member with a plurality of panel fasteners that fasten a fixed member to a lower panel of the garage door; and loosening the plurality of panel fasteners to remove the fixed member from the garage door panel.

17. The method according to claim 16 further comprising tightening the plurality of panel fasteners to reattach the fixed member to the garage door panel, and tensioning the spring to slide the sliding member into the tensioned position and offset the access apertures relative to the plurality of panel fasteners.

18. The method according to claim 14 further comprising loosening roller mount fasteners, and removing a roller axle from a roller mount.

* * * * *